United States Patent [19]

Tengler

[11] Patent Number: 4,786,257

[45] Date of Patent: Nov. 22, 1988

[54] SHIELDED CABLE TERMINATION ASSEMBLY

[75] Inventor: John N. Tengler, Chico, Calif.

[73] Assignee: Minnesota Mining and Manufacturing Company, St. Paul, Minn.

[21] Appl. No.: 913,723

[22] Filed: Sep. 30, 1986

[51] Int. Cl.[4] ..... H01R 13/658

[52] U.S. Cl. ..... 439/76; 439/98; 439/610

[58] Field of Search ..... 339/14 R, 143 R, 17 LC, 339/17 F, 176 MF, 193 P, 218 M; 439/92, 95, 96, 98, 108, 442, 497, 498, 607–610, 76

[56] References Cited

U.S. PATENT DOCUMENTS

| | | | |
|---|---|---|---|
| 3,496,520 | 2/1970 | Reynolds | 339/95 |
| 3,605,060 | 9/1971 | Praeger et al. | 339/17 |
| 3,951,492 | 4/1976 | Braund | 339/17 |
| 4,029,914 | 6/1977 | Schmidt et al. | 200/1 |
| 4,030,799 | 6/1977 | Venaleck | 339/99 |
| 4,094,564 | 6/1978 | Cacolici | 339/14 L |
| 4,105,278 | 8/1978 | Braund et al. | 339/103 |
| 4,157,612 | 6/1979 | Rainal | 339/143 R |
| 4,225,207 | 9/1980 | Brandeau et al. | 339/95 R |
| 4,310,208 | 1/1982 | Webster et al. | 339/14 |
| 4,367,909 | 1/1983 | Shatto, Jr. et al. | 339/176 |
| 4,408,823 | 10/1983 | Huber | 339/208 |
| 4,420,201 | 12/1983 | Stephenson | 339/14 R |
| 4,422,700 | 12/1983 | Krenz | 339/14 R |
| 4,437,724 | 3/1984 | Volka | 339/143 R |
| 4,451,099 | 5/1984 | Bricker, Jr. et al. | 339/14 |
| 4,579,404 | 4/1986 | Lockard | 339/176 MF |
| 4,582,384 | 4/1986 | Frantz et al. | 339/143 R |
| 4,588,239 | 5/1986 | Venaleck | 339/17 |
| 4,596,428 | 6/1986 | Tengler | 339/14 |
| 4,598,969 | 7/1986 | Stephenson | 439/608 |
| 4,602,830 | 7/1986 | Lockard | 339/14 R |
| 4,605,276 | 8/1986 | Hasircoglu | 339/14 R |
| 4,609,241 | 9/1986 | Peterson | 339/17 |
| 4,639,054 | 1/1987 | Kersbergen | 339/14 R |
| 4,655,515 | 4/1987 | Hamsher et al. | 339/14 R |
| 4,682,828 | 7/1987 | Piper et al. | 439/92 |

*Primary Examiner*—J. Patrick McQuade

*Attorney, Agent, or Firm*—Renner, Otto, Boisselle & Sklar

[57] ABSTRACT

A cable termination assembly comprises a shielded electrical cable or cables including plural wire conductors and an electrical shield or shields therefor, an electrical bus electrically connected to the cable shield or shields, a housing for supporting therein plural electrical contacts and the bus, a printed circuit board electrically connecting the contacts to the respective wire conductors, an electrical shield attached to and at least partly surrounding the housing, the housing including a wire management comb including plural slots for positioning at least some of the wire conductors in a predetermined arrangement for electrical connection to the printed circuit board and an electrically non-conductive body molded directly to the cable or cables, comb, bus and contacts to form a unified structure therewith, and the bus having a portion thereof extending externally of the molded body and electrically connected to the housing shield.

34 Claims, 5 Drawing Sheets

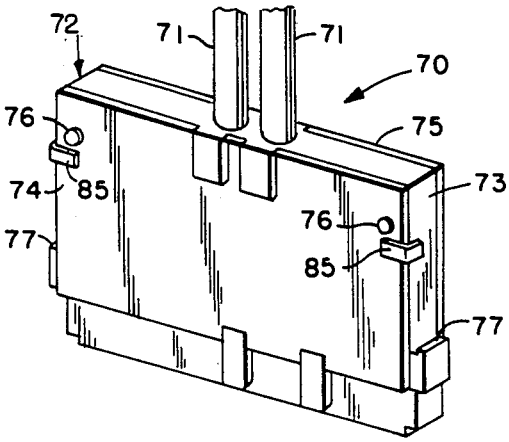
Fig. 9
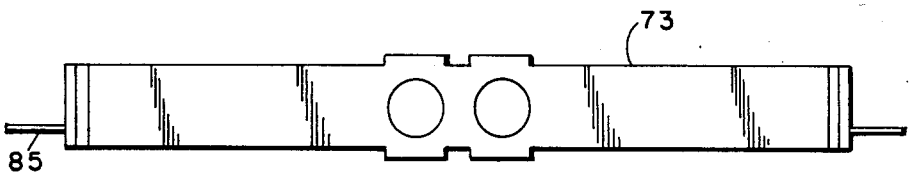
Fig. 11
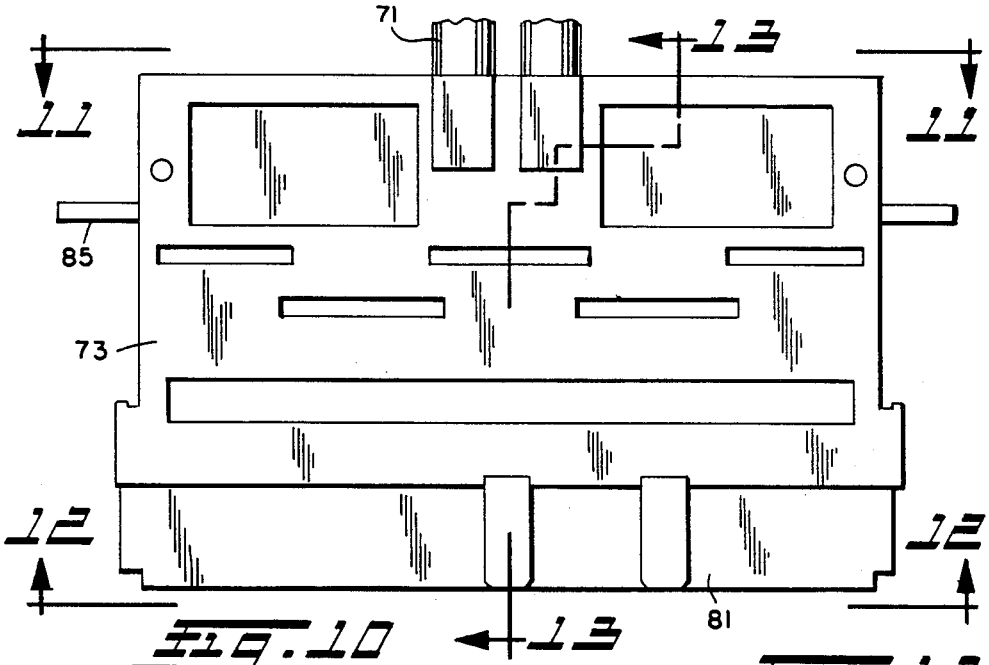
Fig. 10
Fig. 12
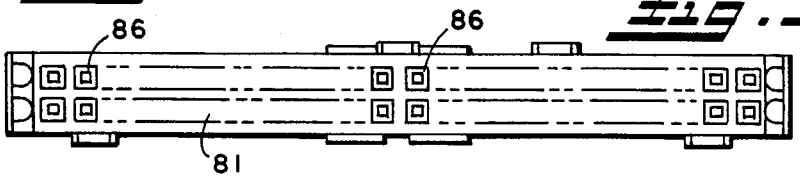

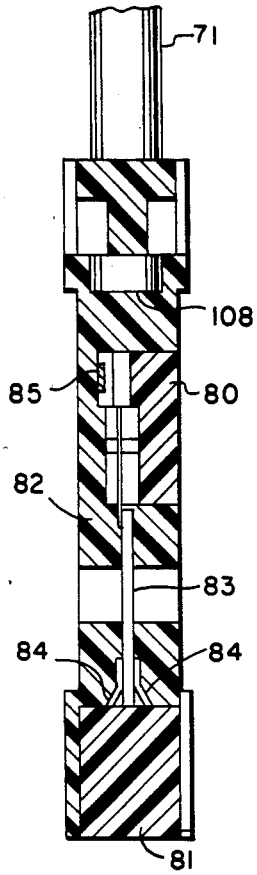
Fig. 13
Fig. 15
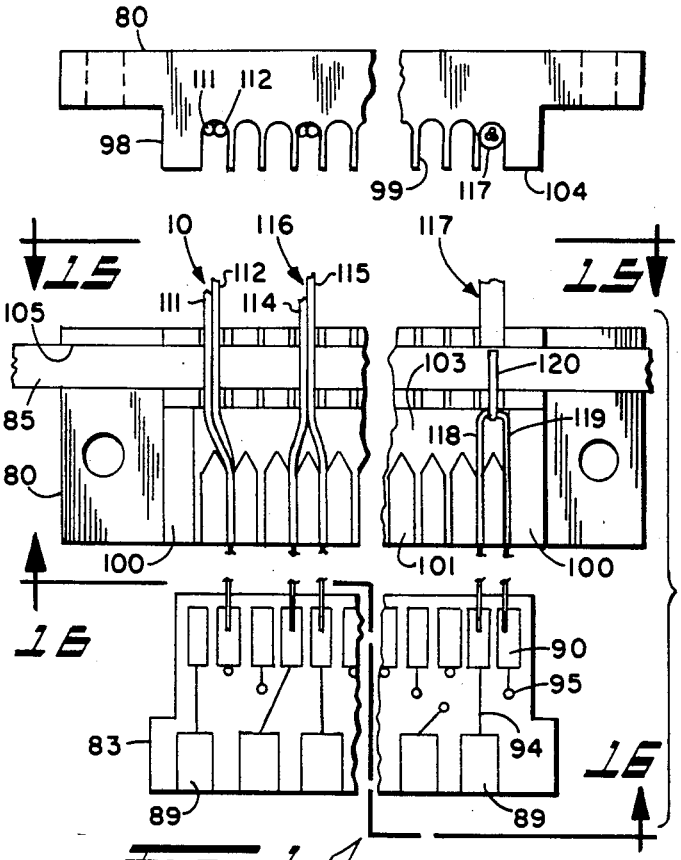
Fig. 14
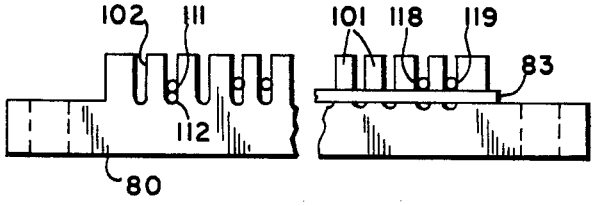
Fig. 16
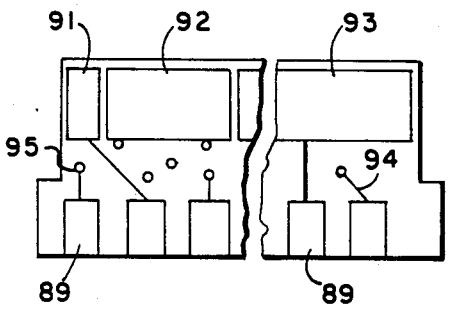
Fig. 17

SHIELDED CABLE TERMINATION ASSEMBLY

The invention herein described relates generally to cable termination assemblies and, more particularly, to cable termination assemblies utilizing shielded electrical cables of various types.

BACKGROUND

In high speed computers, a complex mix of connectors and interconnections typically can be found. These include conventional wires, printed wiring, back panel wiring and interconnecting cables. Among the various types of interconnect cables that have been employed is twisted pair cable which includes a pair of insulated wires that are twisted together along their coextending lengths. The twisted pair along with a drain wire may be surrounded by a cable shield enclosed within an outer cable jacket or sheath to form what is herein referred to as discrete shielded twisted pair cable. It also has been common for multiple twisted pairs to be bundled together and surrounded by a common shield and jacket to form what is herein referred to as round shielded multiple twisted pair cable. This latter type of cable may include within the bundle one or more separately shielded twisted pairs including respective drain wires. Another conventional practice is to arrange the twisted pairs in side-by-side relationship and bond them to a suitable substrate to form what is herein referred to as twisted pair ribbon cable. Preferably the twists are interrupted every few feet and the wires laid parallel to facilitate termination. Also, such cable has been provided with a wrap-around shield to minimize cable-to-cable crosstalk, to help protect the signals carried by the wires from other electromagnetic interference (EMI) sources, and to reduce the amount of energy radiated from the cable. These functions also are performed by the shielding in the other above discussed types of twisted pair cable.

Along with the various types of interconnect cables, various types of cable terminations have been used to terminate the cables for connection to other electrical devices such as headers, pin fields and other electrical connectors. These cable terminations typically include electrical contacts that are electrically connected to respective conductors of the cable and supported in a housing in a desired pattern for connecting with another electrical device. The housing usually performs a strain relief function vis-a-vis the cable conductors and contacts, and together the housing, contacts and cable form what is herein referred to as a cable termination assembly.

Examples of prior cable termination assemblies for electrical cables having signal conductors and ground (isolation) conductors are disclosed in U.S. Pat. Nos. 4,094,564, 4,310,208, and 4,596,428. In the latter patent, a contact carrier has a crenellated surface which not only functions to separate the contacts but also to separate relatively adjacent signal conductors while displacing ground (isolation) conductors for soldered attachment to a ground bus. The contact carrier forms a part of the termination housing, the remaining or balance forming part being formed by a strain relief body molded about the carrier, contacts and conductors to form a unified structure therewith.

SUMMARY OF THE INVENTION

According to present invention, a cable termination assembly comprises shielded electrical cable means for transmitting electrical signals, the cable means including at least one wire conductor and an electrical shield therefor, an electrical bus, housing means for supporting therein at least one electrical contact, means electrically connecting the contact to the wire conductor, and electrical shield means attached to and at least partly surrounding the housing means, the housing means including electrically non-conductive body means molded directly to the cable means, bus and contact to form a unified structure therewith, and said bus having a portion thereof extending externally of the body means and electrically connected to the shield means.

According to another aspect of the invention, a cable termination assembly comprises cable means including a plurality of wire conductors, wire management means including plural slots for positioning at least some of the wire conductors in a predetermined arrangement, a plurality of electrical contact means for electrically connecting with external conductive elements when placed into engagement therewith, means for electrically connecting at least some of the contact means to respective wire conductors, and molded body means molded directly to the wire management means, cable means and contact means to form a unified structure therewith.

According to still another aspect of the invention, a cable termination assembly comprises shielded cable means including at least one wire conductor and an electrical shield therefor, and a shielded cable termination including a housing, at least one contact means supported in the housing and electrically connected to the wire conductor, shield means at least partly surrounding the housing, and means including a crimped clamp for electrically connecting the cable shield to the shield means.

Also provided by the invention is a universal wire management comb for cable termination assemblies including plural wire conductors electrically terminated at contacts supported in a housing. The wire management comb comprises a rear row of laterally spaced slots and a front row of laterally spaced slots of relatively narrower width spaced axially from the front row of slots to form a wire transition region therebetween. Wire management combs also are provided with recess means for locating and supporting a shield ground bus strip.

The foregoing and other features of the invention are hereinafter fully described and particularly pointed out in the claims, the following description and annexed drawings setting forth in detail certain illustrative embodiments of the invention, these being indicative of but a few of the various ways in which the principles of the invention may be employed.

BRIEF DESCRIPTION OF THE DRAWINGS

In the annexed drawings,

FIG. 9 is a perspective view of another cable termination assembly according to the invention;

FIG. 10 is a side view of the cable termination assembly of FIG. 9 exclusive of and prior to attachment of shield plates shown in FIG. 9;

FIG. 11 is a rear end view of the cable termination assembly of FIG. 10 looking generally in the direction of the arrows 11—11 thereof;

FIG. 12 is a front end view of the cable termination assembly of FIG. 10 looking generally in the direction of the arrows 12—12 thereof;

FIG. 13 is a sectional view of the cable termination assembly of FIG. 10 taken substantially along the line 13—13 thereof;

FIG. 14 is a plan view of a sub-assembly employed in the cable termination assembly of FIG. 9, there being shown the top side of a printed circuit board;

FIG. 15 is an elevational view of the sub-assembly of FIG. 14 looking in the direction of the arrows 15—15 thereof;

FIG. 16 is an elevational view of the sub-assembly of FIG. 14 looking in the direction of the arrows 16—16 thereof;

FIG. 17 is a plan view of the bottom side of the printed circuit board of FIG. 14;

DETAILED DESCRIPTION

Referring now in detail to the drawings, several preferred embodiments of the invention are shown. Although some and not all features of the invention are illustrated in any one embodiment thereof, it should be understood that any one feature may be employed independently or in combination with any other feature or features. For a complete understanding of the invention, the following detailed description is provided.

Figure 1:
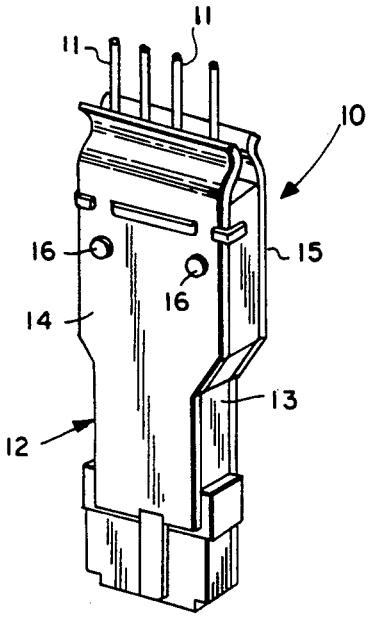
FIG. 1 is a perspective view of a cable termination assembly according to the invention.

In FIG. 1, a cable termination assembly according to the invention is indicated generally at 10. The cable termination assembly 10 includes plural discrete cables 11 and a cable termination 12 for terminating the cables. The cable termination 12 includes a housing 13 and a pair of shield plates 14 and 15 secured to opposite sides of the housing 13 by rivets 16. The shield plates 14 and 15 extend beyond the rear (cable) end of the housing and are curved towards and then away from one another as shown to engage therebetween the cables 11 to provide strain relief in addition to that afforded by the housing 13. Although four discrete cables are shown, the number thereof may vary as desired for any given application and the discrete cables may be tied or otherwise joined together as desired.

With additional reference to FIGS. 2–5, the housing 13 is composed of a wire management comb 18, a front end cap 19 and a balance forming, strain relief body 20 molded directly to the comb 18 and front end cap 19 to form a unified structure therewith. The strain relief body 20 also is molded to and about at least parts of other components of the cable termination 12. These other components include a printed circuit board 21, electrical contacts 22 and a shield ground bus 23. The edges of the housing 13 are recessed to provide shoulders 26 which may be engaged in known manner by locking arms of a header to lock the cable termination to the header. The cable termination can mate, for example, with the header partially shown in broken lines at 24 in FIG. 4. The header 24 preferably is of shielded type having shield plates 25 extending above the header body for engaging and electrically connecting with respective shield plates 14 and 15 of the cable termination as shown.

Figure 3:
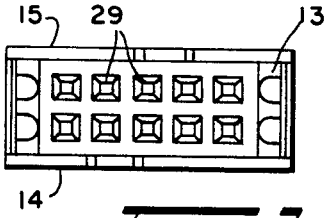
FIG. 3 is a front end view of the cable termination assembly looking in the direction of the arrows 3—3 of FIG. 2.

In the illustrated cable termination 12 which is of female type, the end cap 19 has in a front wall thereof a plurality of tapered access holes or openings 29 as seen in FIG. 3. The access holes 29 provide access to respective chambers or cells in the end cap in which respective contacting portions of the contacts 22 are accommodated within a measure of confinement. The chambers and contacting portions of the contacts are not shown in as much as the same may be of any suitable type. For example, the contacting portion of each contact may be of female fork type including a pair of tines for electrically connecting with a male contact such as a pin contact inserted therebetween via the respective access hole 29. For details of an exemplary female type contacting portion and related housing structure, reference may be had to U.S. Pat. No. 4,596,428. The number of contacts and associated access holes and chambers may be varied for any particular application as may their arrangement in the end cap. It also should be understood that the cable termination may be of other than female type such as of male type having outwardly protruding pin type contacting portions in which case the end cap may be eliminated or appropriately modified. More generally, the front end of the cable termination may be modified for any number of different applications.

Figure 4:
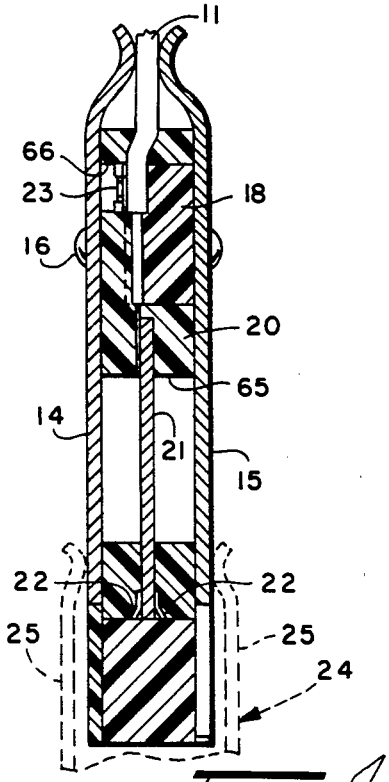
FIG. 4 is a sectional view of the cable termination assembly taken substantially along the line 4—4 of FIG. 2.

In addition to the female contacting portion, each contact 22 also has a rearwardly extending tail portion, this being the part of the contact shown in FIG. 4. The tail portions of the contacts are attached and electrically connected as by soldering to respective contact terminal pads 34 on the printed circuit board 21 best seen in FIGS. 5 and 6. In the illustrated cable termination 12 having contacts 22 arranged in a dual-in-line pattern, the tail portions of contacts in one row are soldered to contact pads on one side of the printed circuit board and those in the other row are soldered to contact pads on the other side of the printed circuit board. The contact terminal pads on each side of the printed circuit board may, as in the illustrated cable termination, be positioned directly opposite respective contact terminal pads on the other side to permit use of identical contacts of linear rather than offset type while still providing a dual-in-line pattern of contacts.

The contact terminal pads 34 on each side of the printed circuit board 21 are arranged along the forward edge of the board whereas other terminal pads 36 are arranged along the rear edge of the board for attachment thereto of conductors of the cables 11. Printed circuit traces 37 and plated through holes 38 electrically connect terminal pads at one end of the board to terminal pads at the other end of the board. For example, terminal pad 36*a* is connected to terminal pad 34*a* by printed circuit trace 37*a*. Further with respect to the illustrated printed circuit board, one side of the board has all of the conductor terminal pads 36 spaced along the rear edge thereof while the other side is provided with a ground bus pad 39 extending substantially the width of the printed circuit board. It should be understood that the interconnect pattern of conductive paths on and/or through the printed circuit board may be varied to provide for desired routing of electrical signals between conductors of the cables 11 and contacts 22, and possibly other functions such as an impedance control, switching, signal modifying and even logic functions.

Figure 5:
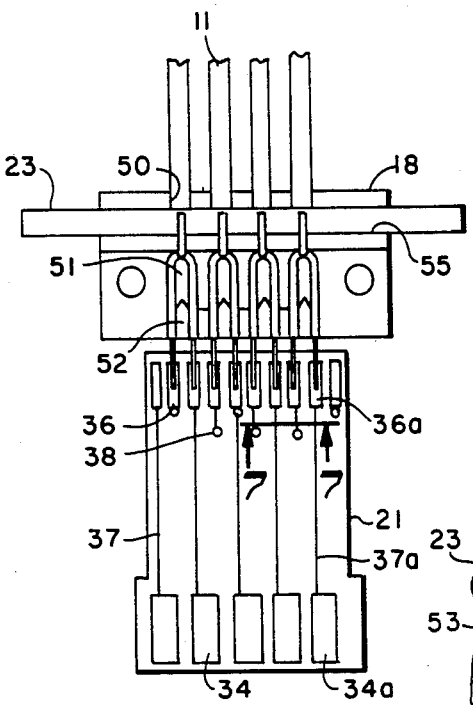
FIG. 5 is a plan view of a sub-assembly employed in the cable termination assembly of FIG. 1, there being shown the top side of a printed circuit board.
Figure 7:
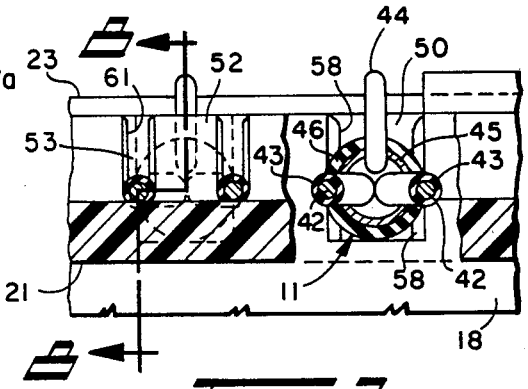
FIG. 7 is a partial sectional view of the sub-assembly of FIG. 5 taken substantially along the line 7—7 thereof.
Figure 8:
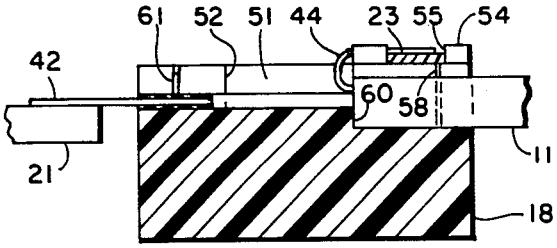
FIG. 8 is a partial sectional view of the sub-assembly of FIG. 6 taken substantially along the line 8—8 of FIG. 7.

With reference to FIGS. 5, 7 and 8, each cable 11 utilized in the illustrated embodiment is of discrete shielded twisted pair type including a pair of electrical conductors or wires 42 which are individually insulated by insulations 43 and twisted together in known manner. Each cable also includes a drain wire 44 for a shield 45 which is surrounded by a cable jacket or sheath 46. The wires 42, herein referred to as signal wires or conductors to distinguish them from the drain wire, are attached as by soldering at insulation stripped ends thereof to respective conductor terminal pads 36 on the printed circuit board 21. The drain wire 44 for each cable 11 is attached as by soldering to the ground bus 23 which can be seen to be in the form of an elongate flat thin strip of conductive metal. Although both wires 42 are herein referred to as signal wires, this is not intended to preclude usage of either wire for purposes other than transmission of electrical signals such as digital signals.

During assembly of the cable termination assembly 10, the cables 11 are organized and the conductors 42, 44 and 45 thereof are properly positioned by use of the wire management comb 18. The comb, which generally is of rectangular block shape, has at the top side thereof a rear row of cable receiving slots 50 which communicate with a forwardly disposed channel 51. At its forward end, the channel 51 is divided by separator walls 52 to form a forward row of wire receiving slots 53. The top side of the comb is also upwardly stepped at its rear portion to provide an elevated top surface 54 which has formed therein a transversely extending channel 55 for receiving and locating the ground bus 23.

In the illustrated embodiment, four cable receiving slots 50 are provided and uniformly spaced apart to receive the cables 11 and to maintain them correspondingly spaced apart. As shown the slots 50 are sized closely to receive the sheathed cables 11 and the side walls of each slot may be provided with inwardly projecting retention ribs 58 which bite into the sheath 46 of the cable to prevent axial shifting of the cable in the slot. One or more retention ribs 58 may be provided with the retention rib or ribs on one side wall of the slot preferably being staggered along the length of the cable with respect to a rib or ribs on the opposite side wall of the slot.

Forwardly of the cable receiving slots 50, the signal wires 42 fan out for passage through respective wire slots 53 at end portions thereof from which the cable shield 45 and sheath 46 have been removed. As for the drain wire 44 of each cable, the exposed end portion thereof is brought upwardly and then rearwardly for attachment as by soldering to the top surface of the ground bus 23 retained in the slot 55 at the top of the wire management comb 18. If the cable is not provided with a drain wire, an end portion of the shield 45 from which the sheath 46 has been removed may similarly be brought up and back for electrical connection to the ground bus. In this manner the drain wires and/or shields of the cable are commonly bussed.

Figure 6:
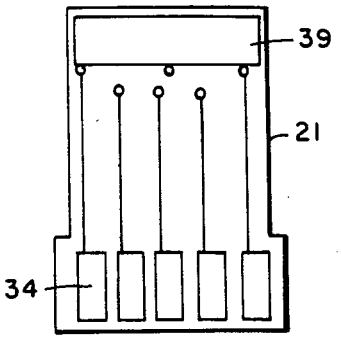
FIG. 6 is a plan view of the bottom side of the printed circuit board of FIG. 5.

As seen in FIGS. 6 and 7, the bottom of each cable receiving slot 50 is at a lower elevation than the bottom of the channel 51 or slots 53 to accommodate the larger diameter of the cable sheath and to provide a shoulder 60 which further facilitates proper positioning of the cables by butting of the end face of the cable sheath thereagainst. The signal wires 42 extend forwardly from the end of the sheath and into respective wire receiving slots 53. The slots 53 may be provided at the side walls thereof with one or more, preferably staggered, retention ribs 61. The retention ribs 61 bite into the insulation 43 on the signal wires to prevent axial shifting thereof in the slot.

Forwardly of the wire management comb 18, end portions of the signal wires 42 have the insulations 43 stripped therefrom for attachment as by soldering to respective terminal pads 36 on the top surface on the printed circuit board 21. As best seen in FIG. 5, the slots 53 and respective terminal pads 36 are correspondingly spaced apart, as at 0.050 inch center-to-center spacing, whereby the comb will position and guide the signal wires and then hold them properly aligned with the terminal pads 36 for soldering. Such positioning and guiding of the signal wires relative to the printed circuit board may be further facilitated by use of a jig which holds the wire management comb and printed circuit board in proper relationship during insertion of the cables 11 into the wire management comb and soldering of the wires to the printed circuit board. When assembled together as above described, the printed circuit board, cables and wire management comb together form the sub-assembly illustrated in FIGS. 5, 7 and 8.

The sub-assembly of FIGS. 5, 7 and 8 is placed in a mold (if not directly assembled therein or a part of the mold) to mold the balance forming, strain relief body 20 of the housing 13. The end cap 19 also is placed in the mold after having been assembled with respect to the contacts 22 attached to the printed circuit board 21 as above-described. Although not shown, the end cap has a rear wall including plural holes in which the contacts are closely fitted to provide a close off which prevents molding material from entering and filling the pin receiving chambers of the end cap.

After such loading of the components in the mold, the mold is closed and the balance 20 of the housing 13 is molded, as by injection molding, to such components to form a unified structure therewith. The molded strain relief body 20 preferably encapsulates the electrical junctions between the signal wires 42 and terminal pads 36 on the printed circuit board 21 and those between the contacts and the terminal pads 34. The mold also preferably includes mold cores and/or locating elements for forming cored out areas in the balance forming part of the housing and/or for locating and holding the components in proper position in the mold.

Cored out areas may be provided to reduce material requirements and to avoid thick plastic sections that may be subject to sinking during cooling of the molding material. As seen in FIGS. 3 and 4, relatively large cored out areas 65 are provided on opposite sides of the printed circuit board 21 for these purposes. These cored out areas 65 also may serve as windows permitting access to the printed circuit board as may be desired for some applications. For example, it may be desirable to access a switch provided on the printed circuit board to alter a characteristic thereof. It also may be desirable to mount other electrical devices to the printed circuit board to give the same a certain characteristic or characteristics after the balance forming body 20 has been molded. Such a device may be a programmed or programmable device similar to the devices disclosed in U.S. Pat. Nos. 4,588,239 and 4,609,241 for post-assembly selection of the signal routing performed by the printed circuit board between the cable conductors and the contacts. A cored out area also may be provided in the region of the ground bus 23 as seen at 66. The core elements used to form the cored out areas preferably engage the wire management comb 18 and the printed circuit board 21 to hold them in place in the mold. The wire management comb also would be located properly in the mold by core pins extending through the rivet holes at opposite lateral ends of the comb.

Figure 2:
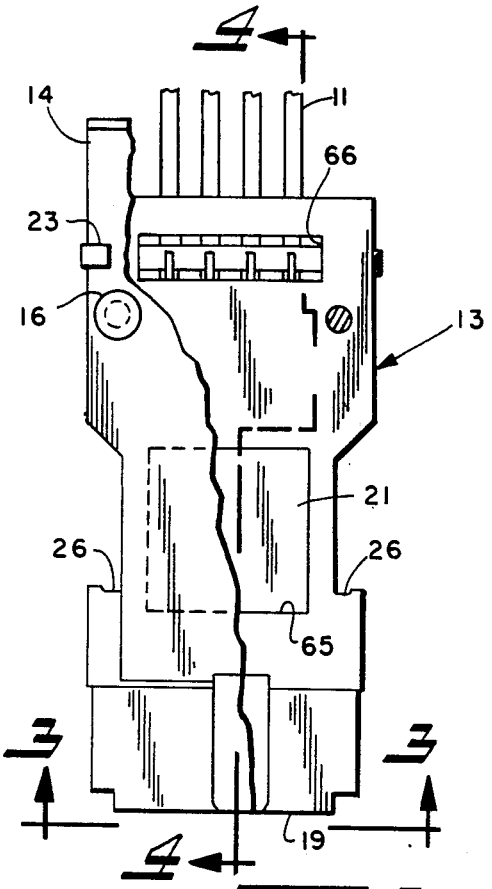
FIG. 2 is a side view, partly broken away in section, of the cable termination assembly of FIG. 1.

After molding of the balance forming part 20, the shield plates 14 and 15 are attached to opposite sides of the housing 13 by the rivets 16 as above-described. Then, the ends of the ground bus 23, which then would be projecting from the sides of the molded strain relief body 20, are bent around and over onto one of the shield plates for soldering thereto as seen in FIGS. 1 and 2. If desired, one end of the ground bus may be soldered to one shield plate and the other end soldered to the other shield plate.

Turning now to FIG. 9, another cable termination assembly according to the invention is indicated generally at 70. The cable termination assembly 70 is adapted for use with round shielded multiple twisted pair cable and, more particularly, two cables 71 of such type. The cables 71 are terminated by a cable termination 72 including a housing 73 and a pair of shield plates 74 and 75 secured to opposite sides of the housing by rivets 76. The edges of the housing are recessed to provide shoulders 77 which may be engaged by locking arms of a header in a manner similar to that above-described with respect to the cable termination assembly 10.

With additional reference to FIGS. 10–13, the housing 73 is composed of a wire management comb 80, a front end cap 81, and a balance forming strain relief body 82 molded directly to the comb and front end cap to form a unified structure therewith. The strain relief body 82 also is molded to and about at least part of a printed circuit board 83, electrical contacts 84, and a ground bus 85. The end cap 81 is similar to that above-described with respect to the cable termination assembly 10, such end cap 81 accordingly having a plurality of tapered access holes or openings 86 which provide access to respective chambers in the end cap in which respective contacting portions of contacts 84 are accommodated.

The tail portions of the contacts 84 are attached and electrically connected as by soldering to respective contact terminal pads 89 on the printed circuit board 83, the top and bottom sides of which are shown in FIGS. 14 and 17, respectively. Again, the contacts may be arranged in a dual-in-line pattern with the contacts of one row being attached to terminal pads on one side of the printed circuit board and those in the other row being attached to terminal pads on the other side of the printed circuit board. The contact terminal pads 89 on each side of the printed circuit board are arranged along the forward edge of the board whereas other terminal pads 90 are arranged along the rear edge of the board for attachment thereto of conductors of the cables 71. As seen in FIGS. 14 and 17, one side of the printed circuit board may have the terminal pads 90 located along the rear edge thereof at a center-to-center spacing equal to one-half the center-to-center spacing of the contact terminal pads 89 while the other side of the printed circuit board may have provided thereon a pluraity of ground bus pads 91–93 to which wire conductors at different ground potentials may be attached. As further shown, the printed circuit board has printed circuit traces 94 and plated through holes 95 for electrically connecting terminal pads at one end thereof to terminal pads at the other end thereof to provide a desired interconnect pattern.

Like the above-described wire management comb 18, the wire management comb 80 functions to organize and guide the conductors of the cables 71 to proper position with respect to the terminal pads 90 at the rear end of the printed circuit board 83. As seen in FIGS. 14–16, the comb 80, which generally is of rectangular block shape, has at the top side thereof a rearward wall section 98 including a plurality of laterally spaced apart slots 99. The comb also has outer side walls 100 extending forwardly from the rearward wall section 98 and defining therebetween a channel-like area which is divided by a plurality of laterally spaced separator walls 101 to form a forward row of wire receiving slots 102. The separator walls 101 rearwardly terminate short of the rear wall section 98 to form a wire transition region 103 between the two rows of slots. The rearward wall section 98 has a slightly elevated top surface 104 which has formed therein a transversely extending recess or channel 105 for receiving and locating the ground bus 85.

In the illustrated embodiment, the rear row of slots 99 has the same center-to-center spacing as the forward row of slots 102, although the forward row has one less slot and the slots thereof are offset with respect to the forward row of slots by one-half the center-to-center spacing thereof. Each slot 99 in the rearward row preferably has a width and height dimension sufficient to accommodulate therein a twisted wire pair of shielded or unshielded type. It is noted that the cables 71 of the indicated type may include both shielded and unshielded twisted pairs, and such twisted pairs may be organized by placement in respective slots 99 at the rear of the wire management comb 80. Further with regard to such organizing of the twisted pairs of the cables, the outer sheaths of the cables may terminate at 108 in FIG. 13 and from there the twisted pairs may fan out to respective slots 99 at the rear of the wire management comb. It also is noted that the shield of each cable may extend byond the end of the sheath and brought to the ground bus 85 for electrical and mechanical attachement thereto.

In FIGS. 14–16, a representative unshield twisted pair is indicated at 110 and can be seen to include two signal wires 111 and 112 which both may be retained within a single slot 99 at the rear end of the wire management comb 80. From this slot the signal wires 111 and 112 of such pair 110 each pass forwardly to and through a wire receiving slot 102 at the front end of the wire management comb for guidance to proper position with respect to the printed circuit board. The signal wires 111 and 112 are stacked one atop the other in a single wire receiving slot 102 for passage out of the slot at different elevations. This facilities guidance and attachment of the top signal wire 111 to a terminal pad at the top side of the printed circuit board 83 and the bottom signal wire 112 to the therewith aligned one of the ground bus pad 91–93 at the bottom side of the printed circuit board. This arrangement may be used, for example, where one of the signal wires carries digital signals and is to be attached to one side of the printed circuit board whereas the other signal wire is maintained at ground potential and is to be attached to a ground bus pad at the bottom side of the printed circuit board perhaps commonly with signal wires of other twisted pairs that are to be maintained at a common ground reference potential.

The wire management comb 90 permits wire management arrangements other than that just described. For example, the signal wires 114 and 115 of a twisted pair 116 may be located in respective different slots 102 at the forward end of the wire management comb as shown in FIGS. 14–16. Also, a shielded twisted pair 117 may have the outer sheath thereof received in a slot 99 in the rearward row. Forwardly of the slot 99 the sheath is stripped to allow independent passage of the signal wires 118 and 119 to and through respective different slots 102 at the forward end of the wire management comb. A shielded twisted pair typically would also have a drain wire 120 which may be brought up and back for attachment to the ground bus 85.

It should be understood that the foregoing wire management arrangements indicate only a few of various wire management arrangements that may be obtained by using the wire management comb 80. Such a comb additionally may be used, for example, with flat ribbon, twisted pair cable. In this latter case, the plural twisted pairs of the cable may be received in respective different ones of the slots 99 with the signal wires thereof extending forwardly for passage through respective wire receiving slots 102 which serve to align properly the signal wires with terminal pads 90 at the rear end of the printed circuit board 83 either at the top or bottom side of the printed circuit board.

After the various electrical connections have been made between the conductors of the cables 71, the ground bus 85, the printed circuit board 83 and the contacts 84, the resultant sub-assembly may then have molded thereto the strain relief body 82. The mold utilized preferably includes mold cores and/or locating elements for forming cored out areas and/or for locating and holding the sub-assembly in proper position in the mold. After such molding, the shield plates 74 and 75 are attached to opposite sides of the housing 73 by the rivets 76 and the ends of the ground bus 85 extending from the sides of the molded strain relief body 82 may be bent around and over onto one or respective ones of the shield plates for soldering thereto as seen in FIG. 9.

Figure 18:
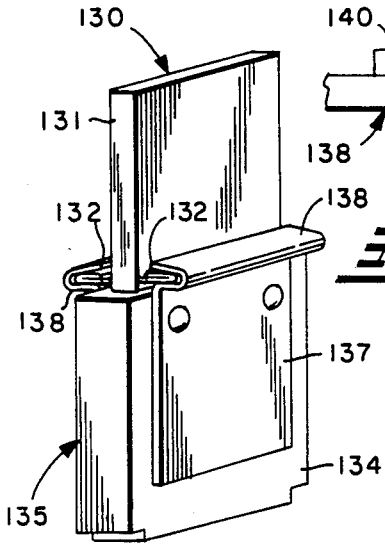
FIG. 18 is a schematic perspective view depicting in partially assembled condition another cable termination assembly according to the invention.
Figure 19:
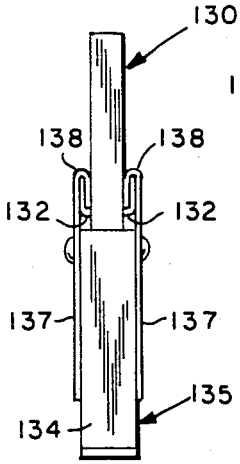
FIG. 19 is a schematic edge side view of the cable termination assembly of FIG. 18 in fully assembled condition.

Referring now to FIGS. 18–28, several techniques for terminating the wrap-around shield of flat ribbon cable are illustrated. In FIGS. 18 and 19, a flat ribbon cable 130 has a wrap-around shield 131. The wrap-around shield 131 at the terminating end thereof has opposite side walls thereof folded outwardly along their widths to form ear-like or tab-like end portions 132 at opposite sides of the cable 130. The shield 131 may be of the type including an inside layer of conductive material such as aluminum or copper and an outer layer or substrate of mylar/polyester. With this type or similar type of shield, the projecting side walls of the shield preferably are reversely folded inside out so that the conductive side thereof is exposed at bottom sides of the then formed double layer ears or tabs 132.

The cable 130 or the conductors thereof extend beyond the ears 132 and are terminated at contacts within the housing 134 of cable termination 135. The cable termination 135 may be of any suitable type for terminating the conductors of the cable; although, preferably, the housing 134 of such cable termination preferably has at least a part thereof molded to the cable, contacts and/or conductors to form a unified structure therewith.

Shield plates 137 are then secured as by rivets to the sides of the housing 134. The shield plates 137 have rear end portions 138 extending rearwardly beyond the housing 134 which are bent outwardly and then inwardly to form linear crimp clamps. The crimp clamps are generally U-shape and open inwardly to receive in the bight thereof respective ears 132. With the ears 132 received within the crimp clamps 138 as shown in FIG. 18, the side walls of the crimp clamps are crimped together to sandwich therebetween the ears 132. The then crimped clamps or end portions 138 of the shield plates 137 preferably are folded rearwardly to align with the major planar extents of the shield plates as seen in FIG. 19.

Figure 20:
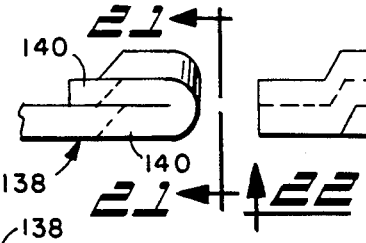
FIG. 20 is a partial end view of a preferred form of crimp clamp employed in the assembly of FIG. 19.
Figure 21:
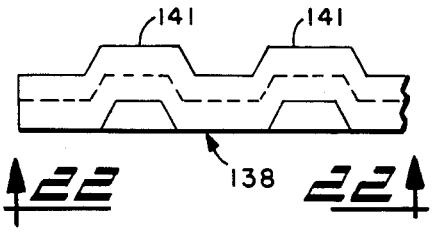
FIG. 21 is a partial edge elevational view of the crimp clamp looking generally in the direction of the arrows 21—21 of FIG. 20.
Figure 22:
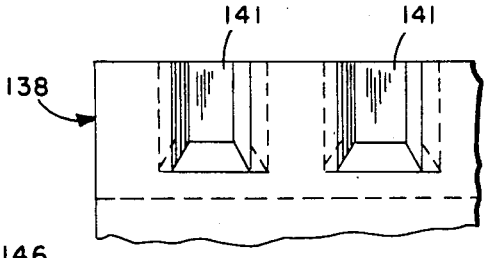
FIG. 22 is a partial plan view of the crimp clamp looking generally in the direction of the arrows 22—22 of FIG. 21.

In FIGS. 20–22 there is illustrated a preferred form of crimp which provides a secure union between the shield plates and the cable shield ears or tabs. As shown, the sides or legs 140 of each linear crimp clamp 138 are upset at locations 141 laterally spaced along the length of the crimp clamp. The cable shield ears 132 accordingly would be similarly deformed to provide a mechanical lock between the ear and the crimp clamp. Also, such plastic deformation of the upset portions 141 strain hardens the crimp clamp further to contribute to a secure union. The upset portions 141 of the crimp clamp may have the illustrated generally frusto-pyramidal shape as is preferred.

Figure 23:
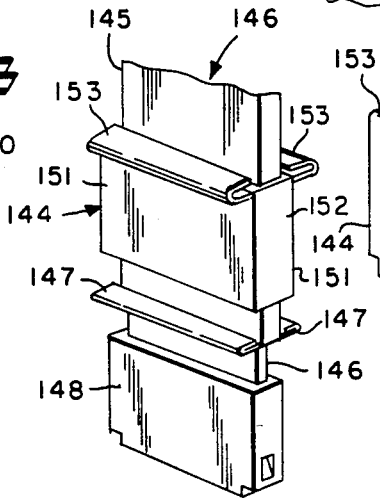
FIG. 23 is a schematic exploded perspective view of another cable termination assembly employing a box shield with shielded flat ribbon cable.
Figure 24:
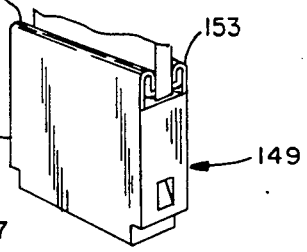
FIG. 24 is a schematic partial perspective view of the cable termination assembly of FIG. 23 in fully assembled condition.

In FIGS. 23 and 24 the illustrated termination technique involves the use of a metal box shield 144 to terminate the wrap-around shield 145 of cable 146. The wrap-around shield 145 at the terminating end thereof has opposite side walls thereof folded outwardly to form ear-like or tab-like end portions 147 at opposite sides of the cable 146. The cable 146 or the conductors thereof extend beyond the ears 147 and are terminated at contacts within the housing 148 of cable termination 149.

The metal box shield has side walls 151 and end walls 152. The side walls 151 have rear end portions 153 which are bent outwardly and then inwardly to form linear crimp clamps substantially like those above-described. The crimp clamps 153 are generally U-shape and open inwardly to receive in the bight thereof the ears 147 after sliding of the box shield over the housing 148. With the ears 147 received within the crimp clamps 153 the side walls of the clamps are crimped together to sandwich therebetween the ears. The thusly crimped clamps or end portions 153 of the box shield preferably are then folded rearwardly to align with the major planar extents of the respective side walls of the box shield as seen in FIG. 24.

Figure 25:
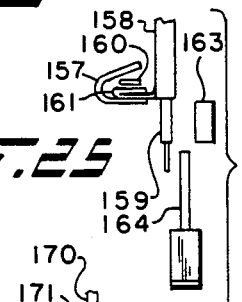
FIG. 25 is a schematic exploded elevational view of another cable termination assembly in partially assembled condition.
Figure 26:
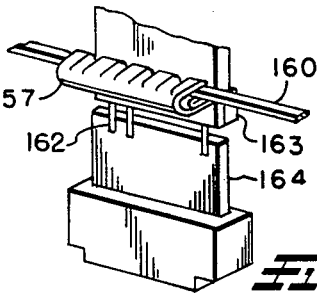
FIG. 26 is a schematic perspective view of the cable termination assembly of FIG. 25 in a further assembled condition.
Figure 27:
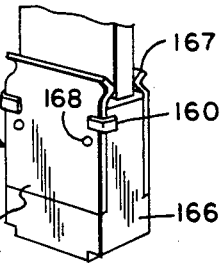
FIG. 27 is a schematic perspective view of the cable termination assembly of FIG. 25 in fully assembled condition.

FIGS. 25–27 illustrate use of a discrete linear crimp clamp 157 for effecting quick and secure mechanical and electrical connection of the shield 158 of cable 159 to a shield ground bus 160. The shield 158 has a side wall thereof folded outwardly to form an ear-like or tab-like end portion 161. The ground bus strip 160 is then placed in juxtaposition with the ear 161 and the crimp clamp 157 is placed thereover as seen in FIG. 25. The crimp clamp then is crimped to join together the cable shield and ground bus. The conductors 162 of the cable extending beyond the end the cable shield 158 may be organized by wire management comb 163 and attached to printed circuit board 164 substantially as above-described in connection with the cable termination assembly 10. Overall, the assembly of the cable termination assembly shown at 165 in FIG. 27 is substantially similar to that of the cable termination 10 except that shielded flat ribbon is used and that the crimp clamp 157 is used to effect electrical connection of cable shield 158 to the ground bus. The crimp clamp preferably is encased within the molded body 166 of the assembly 165 while the ends of the ground bus extend beyond the ends of the crimp clamp and also from the sides of the molded body 166 for soldering to one or respective ones of shield plates 167 secured by rivets 168 to the molded body 166.

Figure 28:
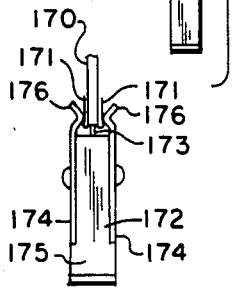
FIG. 28 is a schematic edge side view of another cable termination assembly illustrating still another technique for terminating shielded flat ribbon cable.

FIG. 28 shows still another technique for terminating the wrap-around shield of flat ribbon cable or the like. The wrap-around shield 170 at the terminating end thereof has opposite side walls thereof each folded back upon itself as seen at 171 to expose the conductive inner layer thereof. After assembly of a cable termination 172 to the end of the cable 173 extending beyond the shield 170, shield plates 174 are secured to opposite sides of the cable termination housing 175. The shield plates extend beyond the rear end of the housing and have end portions 176 that are curved inwardly and then outwardly as shown to engage therebetween the cable to provide strain relief and also electrically to connect with the folded back end portions 171 of the shield.

Although the invention has been described with respect to several preferred embodiments, the present invention includes all equivalents and is limited only by the scope of the following claims.

We claim:

1. A cable termination assembly comprising shielded electrical cable means for transmitting electrical signals, said cable means including at least one wire conductor and an electrical shield therefor, an electrical bus, housing means for supporting therein at least one electrical contact electrically connected to said one wire conductor, and electrical shield means attached to and at least partly surrounding said housing means, said housing means including electrically non-conductive body means molded directly to said cable means, bus and contact to form a unified structure therewith, and said bus having a portion thereof extending externally of said body means and electrically connected to said shield means.

2. An assembly as set forth in claim 1, wherein said cable means includes at least two wire conductors and respective shields therefor electrically connected to said bus.

3. An assembly as set forth in claim 2, wherein said body means has opposed sides and said electrical shield means includes generally parallel shield portions at said opposed sides, and said shield portions have bent ends extending beyond said body means for engaging and providing strain relief for said electrical cable means at portions thereof extending from said body means.

4. An assembly as set forth in claim 2, wherein said one contact has a contacting portion for electrically connecting with an external conductive element when placed into engagement therewith, said housing means includes an end cap surrounding said contacting portion of said one contact, and said body means is molded directly to said cable means, bus, contact and end cap to form a unified structure therewith.

5. An assembly as set forth in claim 4, wherein said body means has opposed sides, said electrical shield means includes generally parallel shield portions at said opposed sides, said sides of said body means are recessed with respect to corresponding sides of said end cap, and said shield portions are mounted against said recessed sides of said body means with outer surfaces of said shield means generally flush with said corresponding sides of said end cap.

6. A cable termination assembly comprising shielded electrical cable means for transmitting electrical signals, said cable means including at least one wire conductor and an electrical shield therefor, an electrical bus, housing means for supporting therein at least one electrical contact electrically connected to said one wire conductor, and electrical shield means attached to and at least partly surrounding said housing means, said housing means including electrically non-conductive body means for holding said cable means, bus and contact with respect to one another, and said bus having a portion thereof at least partially contained within said electrically non-conductive body means and another portion thereof extending externally of said body means and electrically connected to said shield means.

7. An assembly as set forth in claim 6, comprising means for electrically connecting said electrical shield to said electrical bus.

8. An assembly as set forth in claim 7, wherein said means for electrically connecting includes a linear crimp clamp for electrically connecting said electrical shield to said shield means, said crimp clamp having generally parallel side portions joined by a linearly extending folded edge portion, said folded edge portion having at least one region thereof upset in a direction generally perpendicular to said side portions to provide a secure union between said crimp clamp and said electrical shield.

9. An assembly as set forth in claim 8, wherein said folded edge portion has a plurality of said upset regions laterally spaced apart along the linear extent of said edge portion.

10. An assembly as set forth in claim 8, wherein said upset region continues into said side portions of said crimp clamp.

11. An assembly as set forth in claim 8, wherein said upset region is generally of frusto-conical shape.

12. An assembly as set forth in claim 11, wherein said upset region does not include any right angle bends.

13. A cable termination assembly comprising a plurality of electrical cables each including at least one wire conductor and a jacket surrounding said wire conductor, wire management means including a row of laterally spaced, cable receiving slots for positioning said cables in laterally spaced apart, generally parallel relationship, and a row of laterally spaced, wire receiving slots of relatively narrower width than said cable receiving slots, said cables having said jackets thereof located in said cable receiving slots and said wire conductors having portions thereof extending beyond said jackets and located in said wire receiving slots, a plurality of electrical contact means for electrically connecting with external conductive elements when placed into engagement therewith, at least some of said electrical contact means being electrically connected with respective wire conductors of said cables, and housing means for securing together said wire management means, cables and electrical contact means.

14. An assembly as set forth in claim 13, wherein said row of cable receiving slots and said row of wire receiving slots are spaced apart in the length direction of said cables to form therebetween a wire transition region communicating with at least two slots in each of said rows of slots.

15. An assembly as set forth in claim 14, including a printed circuit board having circuit means for electrically connecting at least some of said contact means at one end of said board to said wire conductors at the opposite end of said board.

16. An assembly as set forth in claim 15, wherein said opposite end of said board has arranged therealong a plurality of terminal pads for soldered attachment of said wire conductors thereto, and said wire management means positions plural ones of said wire conductors in line with respective ones of said terminal pads.

17. An assembly as set forth in claim 13, wherein each cable includes an electrical shield for said wire conductor thereof, and further comprising an electrical bus to which said electrical shield of at least a plurality of said cables is electrically connected, said wire management means further including a bus slot extending generally in the direction of said row of cable receiving slots for positioning said electrical bus with respect to said cable receiving slots.

18. An assembly as set forth in claim 17, wherein said plurality of electrical contact means includes a plurality of electrical contacts, said housing means includes electrically non-conductive body means molded to said cables, wire management means, bus and contacts to form a unified structure therewith, and said bus has a portion thereof extending externally of said body means and electrically connected to electrical shield means attached to and at least partly surrounding said housing means.

19. An assembly as set forth in claim 13, wherein said plurality of electrical contact means includes a plurality of electrical contacts, and said housing means includes electrically non-conductive body means molded directly to said cables, wire management means and electrical contacts to form a unified structure therewith.

20. An assembly as set forth in claim 13, including a printed circuit board having circuit means for electrically connecting at least some of said contact means at one end of said board to said wire conductors at the opposite end of said board.

21. An assembly as set forth in claim 20, wherein said printed circuit board includes a ground bus pad at said opposite end of said board, and at least some of said cables each include a ground conductor electrically connected to said ground bus pad.

22. An assembly as set forth in claim 20, wherein said printed circuit board includes a plurality of ground bus pads at said opposite end of said board, and selected groups of said cables have ground conductors electrically connected to respective different ones of said ground bus pads.

23. An assembly as set forth in claim 20, wherein said housing means includes electrically non-conductive body means molded to said cables, wire management means and printed circuit board to form a unified structure therewith.

24. An assembly as set forth in claim 23, wherein said body means is molded to only a portion of said printed circuit board thereby to leave exposed another portion of said printed circuit board.

25. An assembly as set forth in claim 20, wherein said printed circuit board has opposite sides, and said plurality of electrical contact means includes a row of said contact means on each said side of said printed circuit board.

26. A cable termination assembly comprising a plurality of electrical cables each including at least one wire conductor and a jacket surrounding said wire conductor, wire management means including a row of laterally spaced, cable receiving slots for positioning said cables in laterally spaced apart, generally parallel relationship, a plurality of electrical contact means for electrically connecting with external conductive elements when placed into engagement therewith, at least some of said electrical contact means being electrically connected with respective wire conductors of said cables, and housing means for securing together said wire management means, cables and electrical contact means, each cable including an electrical shield for said wire conductor thereof, and further comprising an electrical bus to which said electrical shield of at least a plurality of said cables is electrically connected, said wire management means further including a bus slot extending generally in the direction of said row of cable receiving slots for positioning said electrical bus with respect to said cable receiving slots.

27. An assembly as set forth in claim 26, wherein said cable receiving slots have openings at one side of said wire management means, and wherein said bus is positioned by said bus slot so as to span said openings of said cable receiving slots.

28. An assembly as set forth in claim 27, wherein said electrical shields have portions thereof extending beyond the jackets of said cables, and said portions of said shields are reversely bent back for electrical connection to said electrical bus.

29. An assembly as set forth in claim 27, wherein said housing means includes electrically non-conductive body means molded to said cables and wire management means, and said wire management means has at a side opposite said one side a surface which is flush with an external surface of said body means.

30. An assembly as set forth in claim 27, wherein said housing means includes electrically non-conductive body means molded to said cables and wire management means, and said body means includes a core opening coextensive with said electrical bus.

31. An assembly as set forth in claim 28, wherein said portions of said electrical shields include portions of drain wires included in said cables.

32. An assembly as set forth in claim 26, wherein each cable is of shielded twisted type including two wire conductors, respective insulations for said conductors, said electrical shield and a jacket surrounding said wire conductors, insulations and shield.

33. An assembly as set forth in claim 26, wherein said plurality of electrical contact means includes a plurality of electrical contacts, and said housing means includes electrically non-conductive body means molded to said cables, wire management means, bus and electrical contacts to form an integral structure therewith.

34. An assembly as set forth in claim 33, including electrical shield means attached to and at least partly surrounding said housing means, and wherein said bus has a portion thereof extending externally of said body means and electrically connected to said shield means.

* * * * *